US007003130B2

(12) United States Patent
Chung

(10) Patent No.: US 7,003,130 B2
(45) Date of Patent: Feb. 21, 2006

(54) RESONANCE FREQUENCY CORRECTION METHOD AND VIBRATION SPEAKER

(75) Inventor: Seuk Hwan Chung, Suwon-Shi (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 354 days.

(21) Appl. No.: 10/353,556

(22) Filed: Jan. 29, 2003

(65) Prior Publication Data

US 2004/0146175 A1 Jul. 29, 2004

(51) Int. Cl.
*H04R 25/00* (2006.01)

(52) U.S. Cl. ..... 381/396; 381/398; 381/412

(58) Field of Classification Search ..... 381/396, 381/398, 400, 401, 403, 404, 423, 424, 426–430, 381/96, 151, 412, 388.1, 384.1, 7.6, 407.1; 340/388.1, 384.1, 7.6, 407.1; 181/157, 164, 181/166, 168, 171, 172
See application file for complete search history.

(56) References Cited

U.S. PATENT DOCUMENTS 4,709,392 A * 11/1987 Kato et al. ..... 381/430
5,937,075 A * 8/1999 Goller ..... 381/398
6,529,611 B1 * 3/2003 Kobayashi et al. ..... 381/396
6,738,389 B1 * 5/2004 Arato ..... 370/466

* cited by examiner

*Primary Examiner*—Huyen Le
(74) *Attorney, Agent, or Firm*—Darby & Darby

(57) ABSTRACT

A method of correcting a resonance frequency in a vibration speaker generating acoustic sound and vibration includes adjusting the actual resonance frequency to a higher resonance frequency by limiting a predetermined portion of an elastic member installed in a case to an inside of the case to increase the resonance frequency when the actual resonance frequency is not identical to nor less than the desired resonance frequency, thereby adjusting an actual resonance frequency to be identical to a desired resonance frequency, and adjusting the actual resonance frequency to a lower resonance frequency by cutting off another predetermined portion of the elastic member to decrease the resonance frequency when the actual resonance frequency is not identical to nor greater than the desired resonance frequency, thereby adjusting an actual resonance frequency to be identical to a desired resonance frequency. In the vibration speaker, the actual resonance frequency is corrected to the desired resonance frequency, thereby reducing a defect of the vibration speaker.

13 Claims, 10 Drawing Sheets

(Resonance frequency $f_n = \frac{1}{2\pi}\sqrt{\frac{k}{m}}$ m: mass k: spring constant )

FIG. 11

| No | FREQUENCY (Based on 1.8G) | BONDING(3062UV) | | | ADDITIONAL BONDING | | |
|---|---|---|---|---|---|---|---|
| | | 1point | 2point | 3point | 1point | 2point | 3point |
| #1 | 181.06Hz | - | - | 182.36 | | | |
| FREQUENCY INCREMENT AMOUNT | | - | - | 1.3Hz | | | |
| #2 | 178.21Hz | 178.57 | 178.99 | 179.5 | 179.9 | 180.12 | 180.27 |
| FREQUENCY INCREMENT AMOUNT | | 0.36Hz | 0.78Hz | 1.29Hz | 1.69Hz | 1.91Hz | 2.06Hz |

RESONANCE FREQUENCY CORRECTION METHOD AND VIBRATION SPEAKER

BACKGROUND OF THE INVENTION

1. Field of the Invention

The present invention relates to a vibration speaker mounted in a communication system generating acoustic sound and vibration, and more particularly, to a vibration speaker and a method of changing a spring strength of an elastic member to adjust an actual resonance frequency to a designed resonance frequency and to provide a stable vibration characteristic to the vibration speaker.

2. Description of the Related Art

FIG. 1 is a cross-sectional view of a conventional micro speaker used in a mobile (portable) communication terminal. The micro speaker includes a case 100 having an internal space, a magnet 110 and a voice coil 120 mounted in the case 100, and a vibration plate 130 generating audio sound.

In the speaker, a current of a high frequency flows from an external source to the voice coil 120 through a lead line 101 to a magnetic field between the voice coil 120 and the magnet 110. The magnetic field causes the voice coil 120 to more upward and downward, and the vibration plate 130 coupled to the voice coil 120 vibrates to generate the audio sound.

Since the high frequency current supplied to the voice coil 120 through the lead line 101 is an alternative current, depending on a direction of the current flowing through the voice coil 120, and an attraction force is generated between the magnet 110 and the voice coil 120 if the magnetic field formed by the voice coil 120 and another magnetic field formed by the magnet 110 are the same direction. Accordingly, the voice coil 120 moves downward forward the magnet 110 due to the attraction force.

To the contrary, if the magnet field formed by the voice coil 120 and the another magnetic field formed by the magnet 110 are different directions, a repulsive force in generated between the magnet 110 and the voice coil 120, and the voice coil 120 is pushed upward away from the magnet 110.

As described above, the voice coil 120 moves upward and downward according to a change of the magnetic field forward by the voice coil 120 and causes the vibration plate 130 attached to the voice coil 120 to vibrate up and down to generate the audio sound.

The mobile telecommunication terminal is provided with a vibration unit (function) notifying a user of a receiving call using vibration other than the audio sound as well as an audio sound generator.

A vibration motor has been used as the vibration unit. However, it is a technical limitation in minimizing a size of the vibration motor depending on a trend of a slim mobile telecommunication terminal. Recently, a vibration speaker is adopted in the mobile telecommunication terminal as the vibration unit (function) together with the audio sound generator.

FIG. 2 is a cross-sectional view of a conventional vibration speaker. As shown in FIG. 2, the vibration speaker generates the audio sound and the vibration by selectively supplying a high frequency current or a low frequency current to a voice coil 120.

The conventional vibration speaker includes a case 100 forming an external shape and providing an inner space, and a yoke 105 disposed in the inner space of the case 100.

The yoke 105 is provided with a pair of plate springs 150, 155 mounted on inner upper and lower side portions of the case 100.

The plate springs 150, 155 include an outer circumferential side fixedly inserted into grooves 100 formed on the inner upper and lower side portions of the case 100, respectively.

A magnet 110 is mounted on an inner center portion of the yoke 105, and a vibration coil 115 is mounted below the magnet 110, that is, on an upper surface of a lower plate 102 of the case 100.

A vibration plate 130 is mounted on an upper portion of the case, and a voice coil 120 is extended from the vibration plate 130 toward the magnet 110.

In the vibration speaker having the above structure, a weight 140 is provided on an outer side of the yoke 105 to maximize an amount of the vibration, and the weight 140 is disposed between the plate springs 150, 155.

In the conventional vibration speaker having the above structure when a high frequency signal is inputted to the voice coil 120, the vibration plate 130 is minutely vibrated by an electromagnetic force formed among the voice coil 120, the magnet 110 and the vibration coil 115 to generate the audio sound. Accordingly, the vibration speaker can be used as the audio sound generator.

When a low frequency signal is inputted to the vibration coil 115, the yoke 105 moves upward and downward by the electromagnetic force generated between the vibration coil 115 and the magnet 110, and upward and downward movements of the yoke 105 are transmitted to the case 100 through the plate springs 150, 155 to perform the vibration function.

The vibration speaker moves a vibration member constituted of the yoke 105, the magnet 110 and the weight 140 to generate the vibration by harmonizing a resonance frequency of a product employing the vibration speaker with a predetermined frequency.

In the above conventional vibration speaker, a deviation in amounts of respective vibrations of the yoke 105, the magnet 110, and the weight occurs according to an assembly dispersion (variation) of the yoke 105, the magnet 110, and the weight 140, and also, another deviation between a designed resonance frequency and an inherent resonance frequency of the vibration member occurs by the difference in the amounts of the respective vibrations according to a measurement dispersion (variation) of respective parts.

In the assembly dispersion, assembling positions and amounts of attachment of the parts constituting the vibration speaker becomes different from designed ones. In the measurement dispersion, thickness, width, and length of constituents of the vibration speaker becomes different from the designed ones.

Particularly the measurement dispersion occurs mainly in the plate springs 150, 155 which are one of major factors to determine an amount of the vibration. The measurement dispersion of the plate springs 150, 155 occurs due to a small amount of a non-uniform thickness and a difference between an actual measurement and a designed measurement of the plate springs 150, 155.

The plate springs 150, 155 have a non-uniform thickness when the plate springs 150, 155 are manufactured from an original material, such as a steel plate. According to a current technology to make the steel plate, it is impossible to make a perfectly uniform steel plate.

It is also impossible to avoid the difference in forming the plate springs 150, 155 due to a physical limitation.

FIG. 3 is a graph showing a relationship between an amount of the vibration and the designed resonance frequency of the convention vibration speaker. A vibration speaker manufacturer makes the vibration speaker according to the designed resonance frequency requested by a user.

The resonance frequency is 182 Hz or 139 Hz according to characteristics of the telecommunication terminal mounted with the vibration speaker.

The graph of FIG. 3 is an example showing on of various resonance frequencies and the resonance frequency of 182 Hz and the amount of the vibration there from.

As shown in FIG. 3, the vibration speaker manufacturer designs and makes the vibration speaker according to the resonance frequency of 182 Hz. However, the manufactured vibration speaker generates the actual resonance frequency below or above 182 Hz due to the assembly deviation (deflection) and the manufacturing (processing) deviation.

The actual resonance frequency of the manufactured vibration speaker is generated in a region disposed on the right or left with respect of the designed resonance frequency of 182 Hz. As a result, the manufactured vibration speaker becomes a defected speaker having lower vibration characteristics and a lower or higher resonance frequency with respect to the designed resonance frequency.

The resonance frequency can be expressed by a formula, $fn=\frac{1}{2}\pi(K/M)^{1/2}$, where in K is a strength of the plate springs 150, 155 (elastic unit), and M is a mass of the plate spring 150, 155 and the vibration member (vibrator).

As shown in the above formula, the resonance frequency fn is proportional to the strength K and the mass M which are determinants of the resonance frequency.

A general vibration speaker is designed to have the strength of 130 gf/mm and a total vibrator mass of 1.8 gf. According to changes of the strength of 2 gf/mm and the total vibrator mass of 0.03 gf, the resonance frequency is changed by 1 Hz.

Although the mass of 0.03 gf is a very minute amount compared to the total vibrator mass of 1.8 gf, the mass of 0.03 gf affects the resonance frequency very largely since the vibration amount of the vibrator drastically decreases according to a change of the resonance frequency by 2 or 3 Hz.

Also, the strength of 2 gf is a very minute amount compared to the strength of 130 gf. However, the minute amount of the strength by 2 gf affects the frequency very largely like as the change of the total vibrator mass by 0.03 gf. The strength of 2 gf corresponds to a thickness of 1 mm in the plate springs 150, 155.

It is almost impossible to generate the same resonance frequency as the designed resonance frequency of the vibration speaker if the strength and the total vibrator mass of the plate springs 150, 155 are changed even by a small amount.

When the strength and the total vibrator mass of the plate springs 150, 155 are changed, the vibrator cannot maintain a maximum effective vibration amount of 2.5 G, but reaches 3.5 G, and accordingly, an vibration amplitude increases, thereby, causing the vibrator to contact lower and upper surfaces of the case 100.

In order to provide the vibration with the designed resonance frequency as the actual resonance frequency, the strength of the respective parts and the plate springs 150, 155 constituting the vibration speaker must be maintained uniform in a manufacturing process. Accordingly, the manufacturing process should be managed with a very steep restriction on the strength.

However, a manufacturing cost of the vibration speaker increases in proportion to an increase of a parts manufacturing cost if the manufacturing process of the parts is strictly managed to maintain the strength of the parts and the plate springs 150, 155 uniform.

In a method of maintaining the strength and the mass of the plate springs 150, 155, the plate springs 150, 155 are managed to maintain the thickness 1~2 mm. However, it is impossible to technically manage the uniform thickness of 1~2 mm in the plate springs 150, 155.

Even if the strength and the mass of the parts and the plate springs. 150, 155 are maintained, and the parts are strictly managed in the manufacturing process, the defected vibration speaker having a different resonance frequency from the designed resonance frequency due to the assembly dispersion and the measurement dispersion as explained above. Thus, the vibration speaker cannot generate a desirable vibration operation, and a vibration sensitivity of the vibration speaker deteriorates.

The conventional vibration speaker is disadvantageous in that an effective space is limited for the vibrator to move upward and downward since the vibration speaker becomes slim, an unstable vibration occurs due to contact between the vibrator and lower and upper surfaces of the case 100, thereby generating noise and reducing a life-span of the vibration speaker.

SUMMARY OF THE INVENTION

In order to solve the above and/or other problems, it is an aspect of the invention to provide a method of correcting a resonance frequency of a vibration speaker by cutting out a portion of an elastic member to adjust strength of the elastic member.

It is another aspect of the invention to provide a vibration speaker having an elastic member generating a desired resonance frequency to cause a vibrator to vibrate in an effective vibration amount by a resonance frequency correcting method of change strength of the elastic member.

Additional objects and advantages of the invention will be set forth in part in the description which follows and, in part, will be obvious from the description, or may be learned by practice of the invention.

To achieve the above and/or other aspect of the invention, a resonance frequency correcting method in a vibration speaker having a case and an elastic member disposed in the case includes determining whether an actual resonance frequency generated from the vibration speaker is identical to a reference resonance frequency, solidifying an attaching (bonding) element on an elastic portion of the elastic member to change strength of the elastic member to adjust the actual resonance frequency to a higher frequency than the actual resonance frequency when the actual resonance frequency is less than the reference resonance frequency, and solidifying the attaching element on another elastic portion of the elastic member when the higher resonance frequency is identical to the reference resonance frequency.

It is possible that the solidifying of the attaching element includes filling an ejector with the attaching element, applying the attaching element to the elastic portion of the elastic member using the ejector, and curing the attaching element using ultra violet light.

According to another aspect of the invention, a resonance frequency correcting method in a vibration speaker having a case and an elastic member disposed in the case includes determining whether an actual resonance frequency generated from the vibration speaker is identical to a reference resonance frequency, cutting out a cutout portion from an elastic portion of the elastic member to change strength of the elastic member to adjust the actual resonance frequency to a higher frequency than the actual resonance frequency when the actual resonance frequency is less than the reference resonance frequency, and cutting out another cutout portion from the attaching element on another elastic portion of the elastic member when the higher resonance frequency is identical to the reference resonance frequency.

It is possible that the cutting out of the cutout portion includes patterning the elastic member to form the cutout portion on the elastic portion of the elastic member, and cutting out the patterned cutout portion from the elastic portion of the elastic member.

According to another aspect of the invention, a vibration speaker generating audio sound and vibration includes a case having a vibration plate disposed on an upper portion of the case to generate the audio sound, and having a plurality of grooves formed on an inside of the case, a coil having a side portion coupled to the vibration plate to generate an electromagnetic force, a vibration unit disposed adjacent to the coil, having a magnet with opposite polarities, having a yoke attached to the magnet to form a magnetic circuit, and generating the vibration having an actual resonance frequency, an elastic member elastically supporting the vibration unit, having a plurality of arms extended in an outside circumference, and having protrusions formed on the respective arms to be inserted into respective grooves, and causing the vibration unit to generate the actual resonance frequency, and an attaching (bonding) element selectively applied to at least one of the arms to change strength of the elastic member to adjust the actual resonance frequency of the vibration unit.

It is possible that the case includes an insulation plate insulating an inside of the case from an outside of the case.

It is also possible that a vibration coil is disposed on an inside surface of the insulation plate to generate an electromagnetic force corresponding to the magnetic circuit of the vibration unit and to vibrate the vibration unit supported by the elastic member.

It is yet possible that the vibration unit includes a weight disposed on an outside of the yoke to increase a mass of the vibration unit to increase a vibration efficiency of the vibration unit.

It is possible that the elastic member includes a plate spring having a circular shaped plate.

It is possible that the arms are disposed outward to be spaced-apart at an interval in a circular direction.

It is possible that the attaching element is formed on two arms of the elastic member.

It is possible that the attaching element is formed on three arms of the elastic member.

It is possible that the attaching element includes an adhesive applied to both the inside of the case and the protrusions of the elastic member to limit an elastic force of the elastic member to change the strength of the elastic member.

It is possible that the adhesive includes a UV series cured by ultra violet light to be solidified at a curing speed to provide an attaching area of the elastic member and the inside of case.

It is also possible that the UV series includes a 3062 UV series has an anaerobic characteristic to shorten the curing speed.

According to another aspect of the invention, a vibration speaker generating audio sound and vibration includes a case containing a vibration plate disposed on an upper portion of the case to generate the audio sound, and having a plurality of grooves formed on an inside of the case, a coil having a side portion coupled to the vibration plate to generate an electromagnetic force, a vibration unit disposed adjacent to the coil, having a magnet with opposite polarities, having a yoke attached to the magnet to form a magnetic circuit, and generating the vibration having an actual resonance frequency, and an elastic member elastically supporting the vibration unit to cause the vibration unit to generate the actual resonance frequency, having a plurality of arms extended in an outside circumference, and having protrusions formed on the respective arms to be inserted into respective grooves, and having a cutout portion formed on at least one of the arms to change strength of the elastic member to adjust the actual resonance frequency of the vibration unit.

It is possible that the case includes an insulation plate insulating an inside of the case from an outside of the case.

It is also possible that a vibration coil is disposed on an inside surface of the insulation plate to generate an electromagnetic force corresponding to the magnetic circuit of the vibration unit and to vibrate the vibration unit supported by the elastic member.

It is yet possible that the vibration unit includes a weight disposed on an outside of the yoke to increase a mass of the vibration unit to increase a vibration efficiency of the vibration unit.

It is possible that the cutout portion is formed on an outer circumferential surface of the corresponding arm.

It is possible that the cutout portion is formed by grinding an outer circumferential surface of the corresponding arm.

It is also possible that the cutout portion is formed by piercing the corresponding arm.

BRIEF DESCRIPTION OF THE DRAWINGS

These and/or other advantages of the invention will become apparent and more readily appreciated from the following description of the preferred embodiments, taken in conjunction with the accompanying drawings of which:

FIG. 11 is a table showing data representing an amount of the resonance frequency of the vibration speaker shown in FIGS. 8 and 9.

DETAILED DESCRIPTION OF THE PREFERRED EMBODIMENTS

Figure 1:
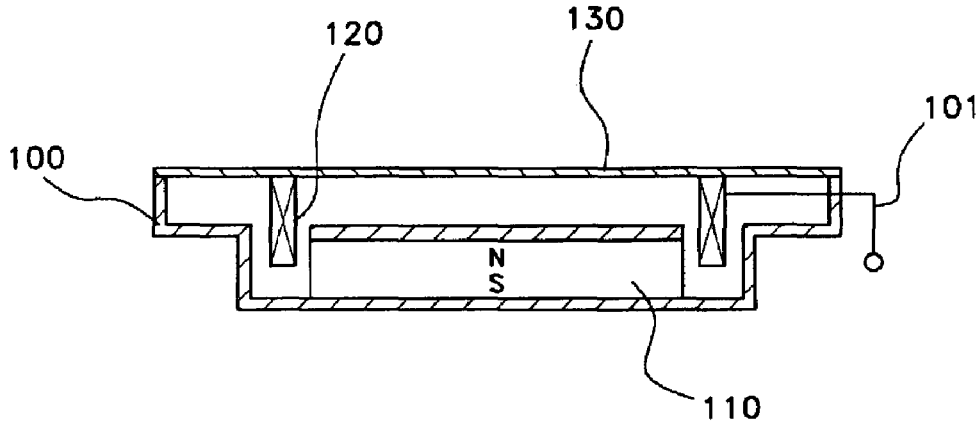
FIG. 1 (CONVENTIONAL ART)
FIG. 1 is a cross-sectional view of a conventional micro speaker.
Figure 2:
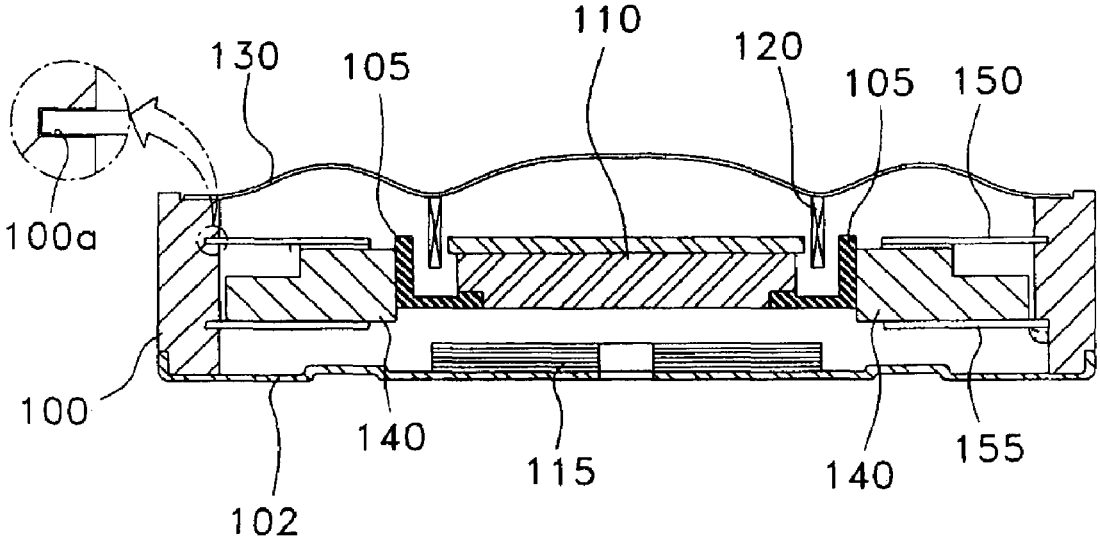
FIG. 2 (CONVENTIONAL ART)
FIG. 2 is a cross-sectional view of a conventional vibration speaker.
Figure 3:
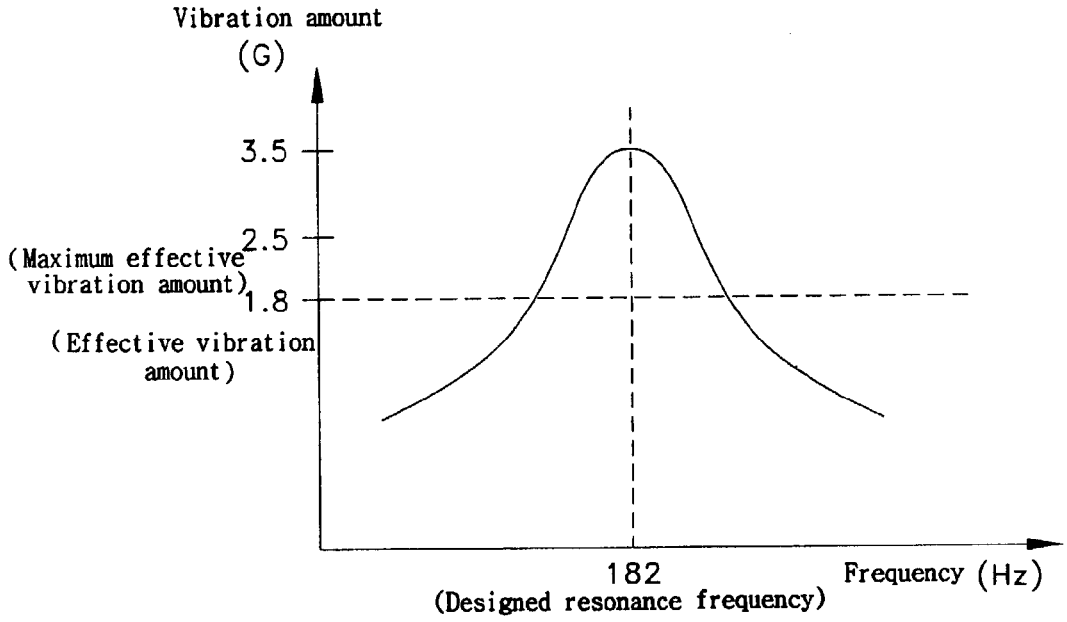
FIG. 3 (CONVENTIONAL ART)
FIG. 3 is a graph showing a relationship between a designed resonance frequency and an amount of vibration in the conventional vibration speaker.

Reference will now be made in detail to the present preferred embodiments of the present invention, examples of which are illustrated in the accompanying drawings, wherein like reference numerals refer to the like elements throughout. The embodiments are described below in order to explain the present invention by reference to the figures.

Hereinafter, a vibration speaker according to an embodiment of the present invention will be described in conjunction with the reformed drawings.

Figure 4:
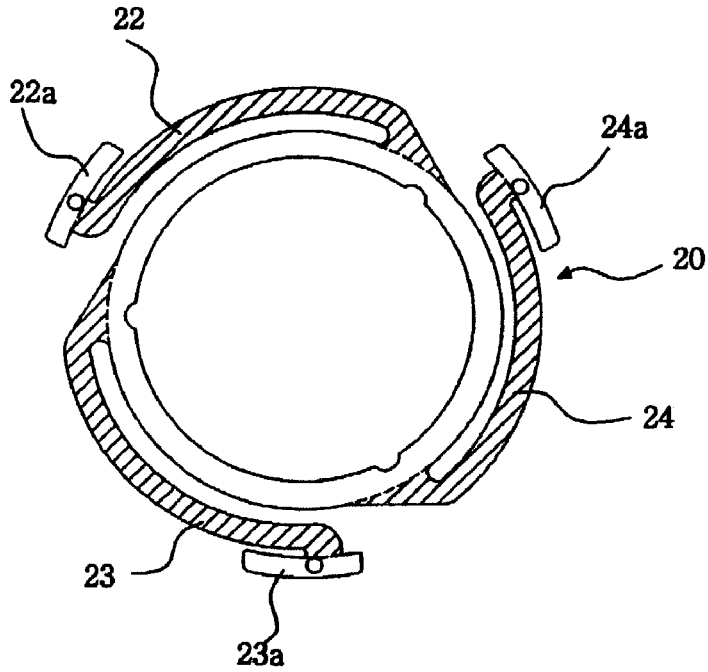
FIG. 4 is a plan view of an elastic member having portions relating a spring constant and mounted on a vibration speaker according to an embodiment of the present invention.

FIG. 4 is a plan view showing an elastic member 20 having spring constant determining portion and mounted on the vibration speaker. The elastic number is a plate type spring.

As shown in FIG. 4, the elastic member is formed in a circular changed plate and has a plurality of arms 22, 23, 24 with a plurality of protrusions 22*a*, 23*a*, 24*a* formed on an outer circumference of the circular shaped plate and inserted into a groove formed on an inside of a case of the vibration speaker which will be described later.

A hatched portion is a determinant determining the spring constant of the elastic member 20. An actual elastic force is generated from this portion in the elastic member 20.

Since the hatched portion corresponds to an elastic portion of the elastic member 20 and the spring constant determining portion, this portion is a determinant of a resonance frequency of the vibration speaker.

The elastic member 20 is a portion of parts constituting a vibrator of the vibration speaker like as conventional vibration speaker, and the hatched portion corresponds to the spring constant K.

Accordingly, the resonance frequency can be adjusted (changed) by changing a strength of the hatching portion corresponding to the spring constant K of the elastic member 20.

That is, according to a formula representing the resonance frequency $fn=\frac{1}{2\pi}(K/M)^{1/2}$, the resonance frequency fn is proportional to a strength K and a mass M of the elastic member 20. When the strength K of the hatched portion corresponding to the arm 22, 23, 24, of the elastic member 20 is changed, the resonance frequency can be easily adjusted.

According to an aspect of the invention, the resonance frequency fn can be easily adjusted by limiting or cutting out the hatched portion of the elastic member 20 of FIG. 4 to change the spring constant K. This process is described in FIGS. 5 and 6.

Figure 5A:
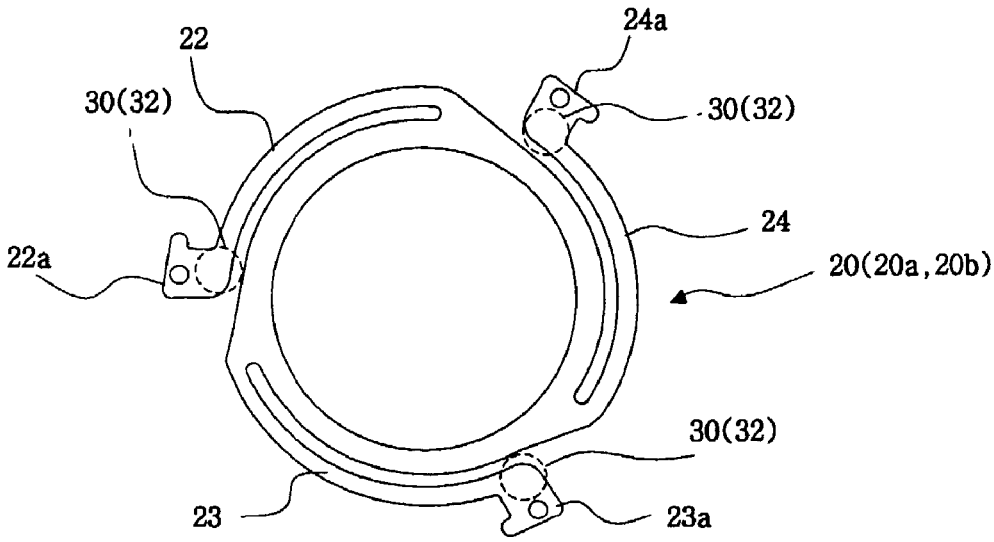
FIGS. 5A, 5B, 5C are plan views showing a position of an adhesive applied to the elastic member, and a change of strength in accordance with the position on the elastic member shown in FIG. 4.
Figure 5B:
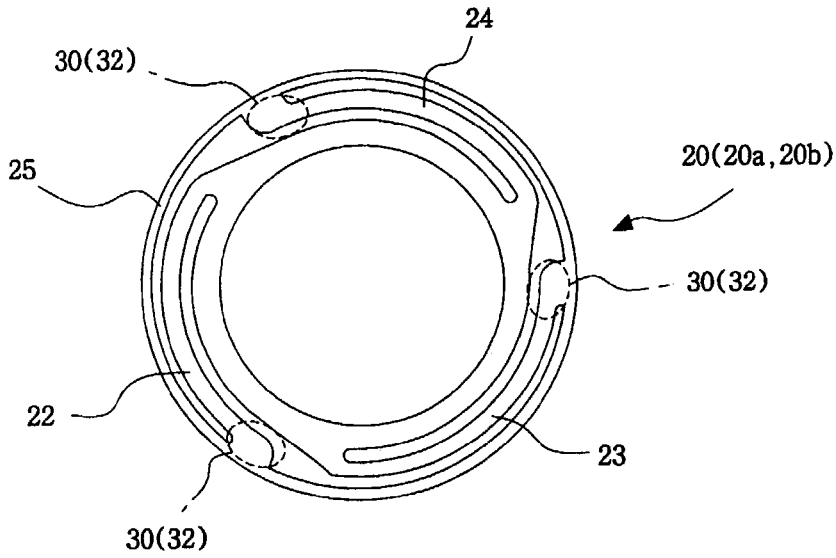
Figure 5C:
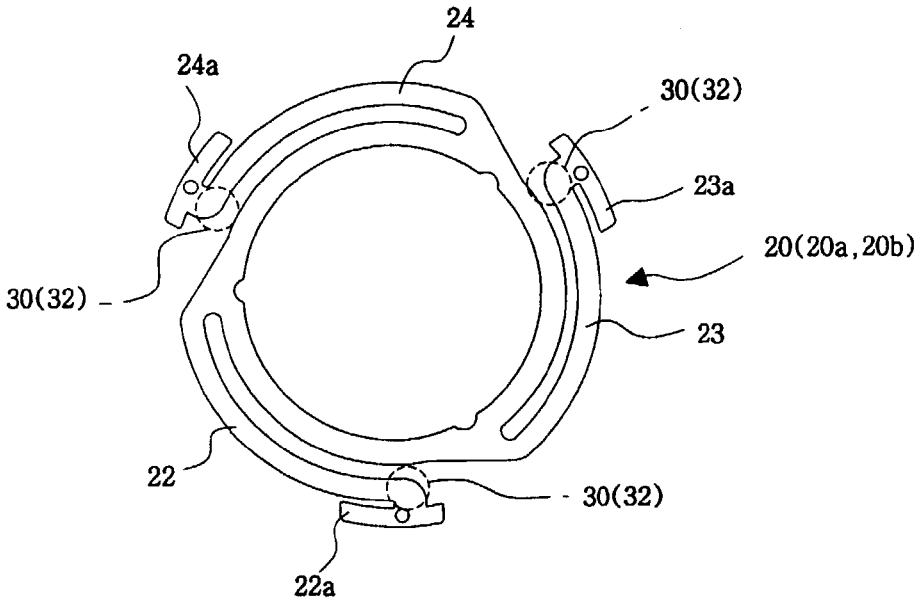

FIGS. 5A–5C are plan views showing positions of an adhesive applied to the elastic member 20 to change the strength K. FIG. 5A shows an A type elastic member having a circular through hole (piercing) formed on an inside of the elastic member 20, FIG. 5B shows a B type elastic member having protrusions of a ring shape formed on an outside of the elastic member having a semi-circular groove (piercing) formed on the inside of the elastic member 20. FIG. 5C shows a C type elastic member having a semi-circular hole (piercing) formed on the inside of the elastic member.

Figure 6A:
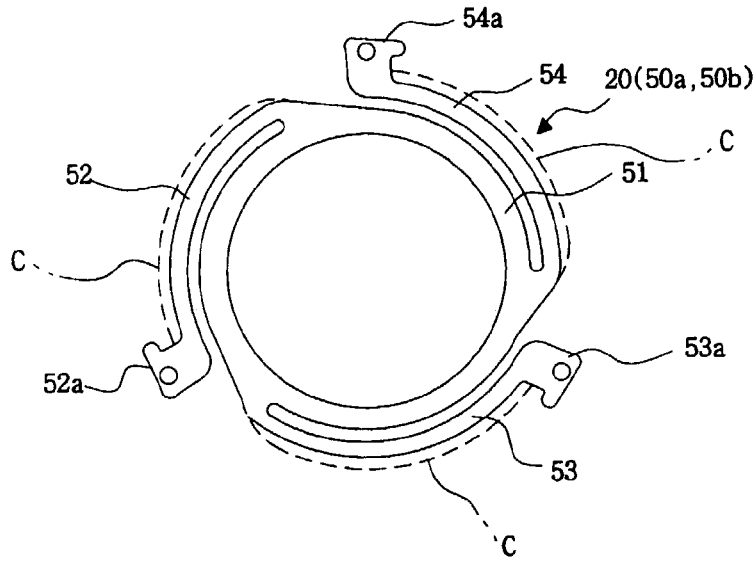
FIGS. 6A and 6B are plan views showing a cutout portion formed on the elastic member, a location of the cutout portion and a change of the location of the cutout portion in the elastic member shown in FIG. 4.
Figure 6B:
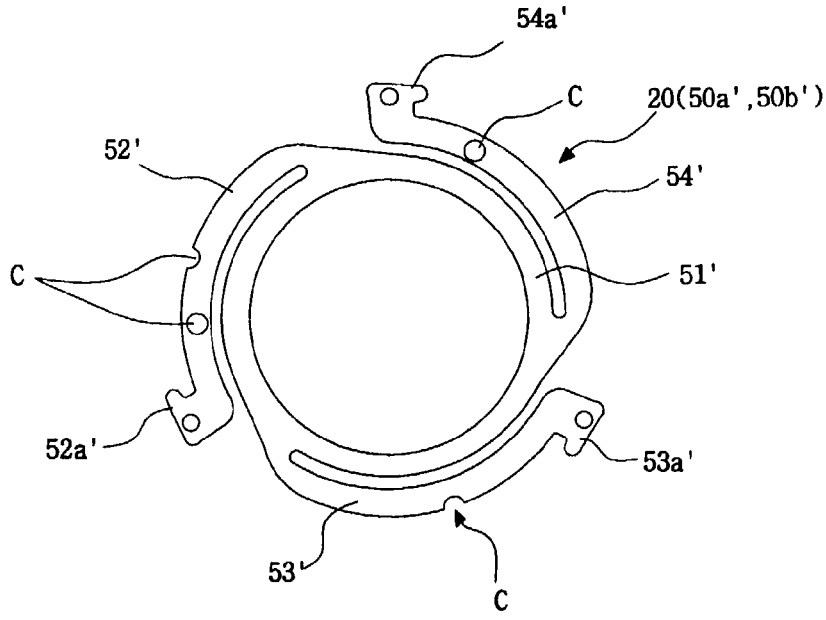

FIGS. 6A and 6B are plan views showing cutout portions formed on the elastic member 20 to change the strength K of the elastic member 20. FIG. 6A shows a plan view of the elastic member 20 having the cutout portions on an outside of the elastic member 20, and FIG. 6B shows another plan view of the elastic member 20 pierced with holes on a predetermined portion of the elastic member 20.

In detail, FIGS. 5A–5C show the elastic member 20 classified into the A type, the B type and the C type according to a shape of the elastic member 20, and the positions of the elastic member 20 on which the adhesive is applied. FIGS. 6A and 6B show various cutout positions and cutout shapes formed on the elastic member 20.

The elastic member 20 is described a plate shaped spring made of a circular thin plate as an example.

In order to change the strength K of the elastic member, the adhesive 32 corresponding to an attaching (bonding) member is solidified on portions of the protrusions 22*a*, 23*a*, 24*a*, of the arms 22, 23, 24 corresponding to the elastic portion of the elastic member 20, or predetermined portions of the arms 52, 53, 54, 52', 53', 54' are cutout.

Referring to FIGS. 5A–5C, a strength changing method of changing the strength K of the elastic member 20 using the adhesive 30 (32) is described below. In order to change the strength K of the elastic member 20, the adhesive 32 is applied to the portions of the protrusions 22*a*, 23*a*, 24*a* of the arms 22, 23, 24, and the portions of the protrusions 22*a*, 23*a*, 24*a* are fixedly inserted into the inside surface of the case 1 of the vibration speaker shown in FIGS. 8–10 (described later).

Although the elastic member 20 having the A type, the B type and the C type may be different but similar in shape, the portions where the adhesive 32 is applied, are similar.

The adhesive 32 has characteristics of operation conditions and efficiency, adhesiveness, heat-resistance, chemical-resistance, freeze-resistance and electrical-conductivity. The adhesive 32 is solidified after being applied to provide an attachment area to the portions of the protrusions 22*a*, 23*a*, 24*a* and is cured at a high speed by ultra violet light. It is possible that the adhesive 32 is a 3062 UV series adhesive shortening a curing speeds using an anaerobic characteristic.

Although not explained above, any other adhesive having the above characteristics can be used as the adhesive 32.

The adhesive 32 is applied for 0.15 seconds using a syringe connected to a needle having a diameter of 0.7 mm to eject an accurate amount of the adhesive 32 on a precise position on the elastic member 20.

The diameter of the needle and an application time of the adhesive 32 may be variable according to the amount of the adhesive 32.

Figure 9:
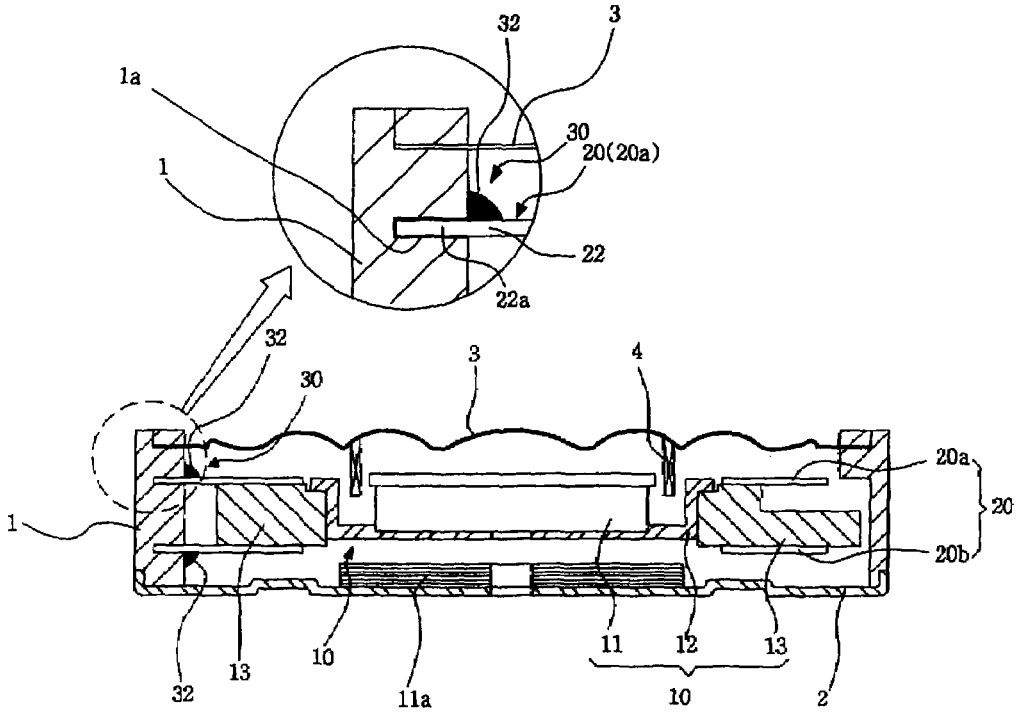
FIG. 9 is a cross-sectional view of the vibration speaker shown in FIG. 8.

After the adhesive 32 is applied using the syringe, the portions of the protrusions 22*a*, 23*a*, 24*a* of the arms 22, 23, 24 of the elastic member 20 is fixedly coupled to the inside of the case 1 of the vibration speaker. Thus, a coupled (fixed) portion of the elastic member 20 is extended, but an elastic portion of the elastic member 20 decreases as shown in FIG. 9 later.

According to a conventional vibration speaker, the protrusions 22*a*, 23*a*, 24*a* of the arms 22, 23, 24 of the elastic member 20 are fixedly coupled to an inside of a case 1. However according to the present invention, a predetermined area of the arms 22, 23, 24 of the elastic member 20 can be fixedly coupled to the inside of the case 1 using the adhesive, thereby extending the coupled (fixed) portion.

To the contrary, another predetermined are such as the elastic portion, of the elastic member 20 decrease as much as the extended coupled (fixed) portion of the elastic member 20.

When the coupled portion of the elastic member 20 increases and the elastic portion of the elastic member 20 decreases, the strength K of the elastic member 20 is changed to increase, and the resonance frequency can be adjusted to a higher resonance frequency according to the resonance frequency formula $fn=\frac{1}{2}\pi\ (K/M)^{1/2}$ That is, when an actual resonance frequency is lower than a designed (desired) resonance frequency, the adhesive 32 is applied to distant ends of the arms 22, 23, 24 of the elastic member 20 to change the strength K of the elastic member, thereby increasing the actual resonance frequency to the higher resonance frequency close to or the same as the designed resonance frequency.

It is possible that the adhesive 32 selectively applied to one of the arms 22, 23, 24 of the elastic member 20 according to a magnitude of the actual resonance frequency. It is also possible that the adhesive 32 maybe applied to one or more arms 22, 23, 24.

Referring to FIGS. 6A and 6B, a process of changing the strength K of the elastic member 20 by cutting out the elastic member 20 is described below. The elastic member 20 of FIGS. 6A and 6B is the plate spring 50*a*, 50*b*, 50*a*', 50*b*' having an area adjusted by a cutout portion compared to the area of the plate spring 20 (20*a*, 20*b*) of FIGS. 5A–5C.

As described above, when an elastic area of the elastic portion of the elastic member 20 having the strength K decreases, the arms 52, 53, 54, 52', 53', 54' of the elastic member 20 perforate or are cutout to decrease the elastic area of the elastic member 20.

Referring to FIG. 6A, a cutout portion C is formed on an outer circumferential side of the arms 52, 53, 54 of the plate springs 50*a*, 50*b* of the elastic member 20 by cutting out or grinding a portion of the arms 52, 53, 54.

The cutout portion C formed on the outer circumferential side of the arms 52, 53, 54 is indicated by broken lines in FIGS. 6A and 6B. The cutout portion C is formed by cutting or grinding.

For example, the cutout portion C indicated by the broken lines is cutoff to decrease the elastic member 20 by a large area, and is ground the elastic member 20 to decrease by a small area.

Instead of cutting and grinding, the arms 52' 53' 54' of the plate springs 50*a*', 50*b*' of the elastic member 20 are formed with holes by perforating and piercing. The number of the holes varies according to the strength K.

When the area of the elastic member 20 decreases by grinding and piercing (perforating), the strength is weakened, and a value of K decreases. Accordingly, the resonance frequency can be adjusted to a lower resonance frequency according to the formula $fn=\frac{1}{2}\ (K/M)^{1/2}$.

When the actual resonance frequency is generated from the elastic member 20 higher than the designed resonance frequency, the cutout portion C is formed on the elastic member 20 to change the area of the elastic member 20, and the actual resonance frequency is lowered to the designed resonance frequency.

According to the magnitude of the actual resonance frequency, one of the arms 52, 53, 54, 52', 53', 54' of the elastic member 20 is formed with the cutout portion or the perforation, and one or more arms 52, 53, 54, 52', 53', 54' of the elastic member 20 are formed with the cutout portion or the perforation.

The adjustment of the resonance frequency according to the change of the strength K of the elastic member 20 shown in FIGS. 5A–6B will be described later in FIGS. 8–10.

Figure 7A:
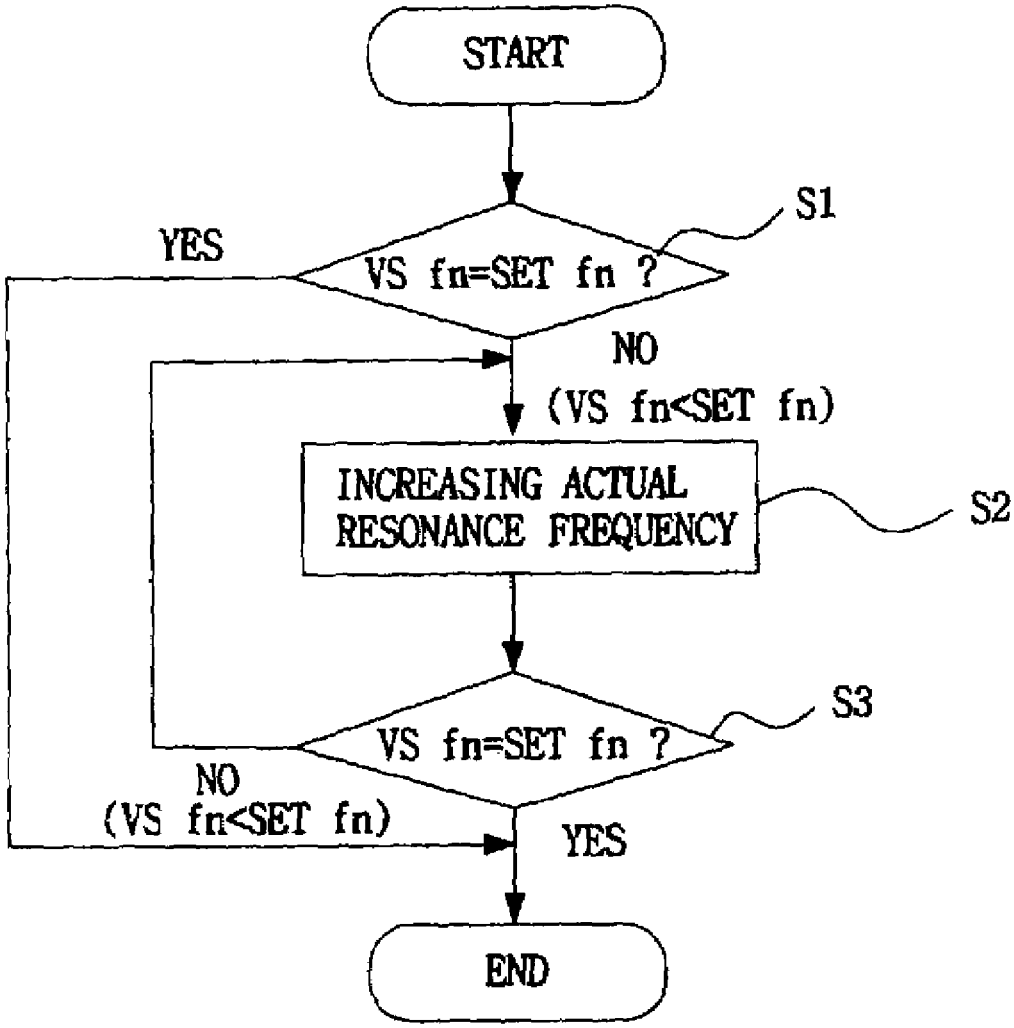
FIG. 7A is a flow chart showing a process of compensating for a resonance frequency of a vibration speaker having the elastic member shown in FIGS. 5A, 5B and 5C.
Figure 7B:
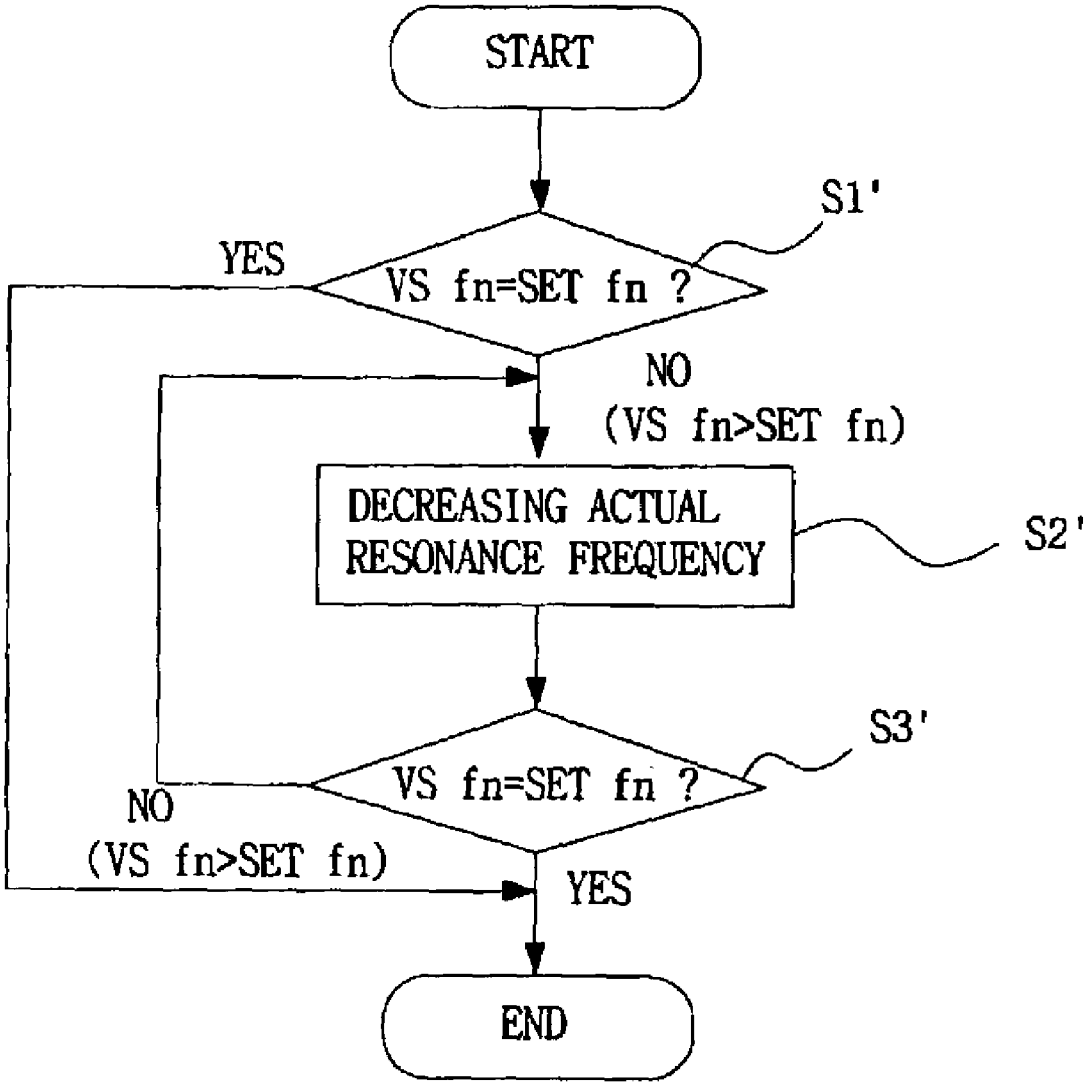
FIG. 7B is another flow chart showing another process of compensating for a resonance frequency of the vibration speaker having the elastic member shown in FIGS. 6A and 6B.

FIGS. 7A and 7B show processes of correcting the resonance frequency of the vibration speaker by providing the cutout portion C and the attaching element 30 to the elastic member 20. FIG. 7A is a flow chart of correcting the actual resonance frequency according to another embodiment of the present invention and FIG. 7B is another flow chart of correcting the actual resonance frequency according to another embodiment of the present invention.

In the method of correcting the resonance frequency of the vibration speaker as shown in FIGS. 7A and 7B, the actual resonance frequency (VS fn) of the vibration speaker is different from the designed resonance frequency SET fn, the actual resonance frequency VS fn is adjusted to the designed resonance frequency SET fn selectively using the method of lowering or increasing the actual resonance frequency VS fn.

Referring to FIG. 7A, the actual resonance frequency VS fn generated from the manufactured vibration speaker is compared with the designed resonance frequency SET fn is operation S1.

If the actual resonance frequency VS fn is lower than the designed resonance frequency SET fn in operation S1, the attaching element 30 is provided to be solidified on the elastic portion of the elastic member 20 which is mounted on the inside of the case 1 of the vibration speaker, to extend the fixed portion of the elastic member 20, thereby changing the strength K of the elastic member 20 and increasing the actual resonance frequency VS fn in operation S2.

That is, in operation S2, the strength K of the elastic member 20 is changed when the fixed portion of the elastic member 20 is extended due to the application of the attaching element 30 on the elastic portion of the elastic member 20 to increase the actual resonance frequency VS fn up to the designed resonance frequency SET fn.

The adhesive 32 is used as the attaching element 30, and a 3062 series of the UV series can be used as the attaching element 30.

Although described above, the application of the attaching element 30 includes filing the syringe with the attaching element 30, applying the attaching element 30 on the elastic portion of the elastic member 20 using the syringe, and curing the attaching element 30 using the ultra violet light.

It is determined that another actual resonance frequency VS fn of the vibration speaker having the adjusted elastic portion of the elastic member in operation S2 is identical to the designed resonance frequency SET fn, is not identical to the designed resonance frequency SET fn but lower than that, operation S2 repeats in operation S3.

The method of correcting the actual resonance frequency VS fn includes operations S1, S2, S3 as described above.

If the actual resonance frequency VS fn is higher than the designed resonance frequency SET fn, the actual resonance frequency VS fn can be corrected using the process shown in FIG. 7B.

According to the method of FIG. 7B, it is determined that the actual resonance frequency VS fn is identical to the designed resonance frequency SET fn in operation S1'.

When the actual resonance frequency VS fn is higher than the designed resonance frequency SET fn, the cutout portion C is provided on the elastic portion of the elastic member 20 fixedly coupled to the insides of the case 1 of manufactured vibration speaker to change the strength K to lower the actual resonance frequency VS fn of the vibration speaker in operation S2'.

Operation S2' includes patterning the elastic portion of the elastic member 20 to have the cutout portion C and forming the cutout portion C of the patterned elastic portion of the elastic member 20 using one of cutting, piercing and grinding.

It is determined that another actual resonance frequency VS fn of the vibration speaker is identical to the designed resonance frequency SET fn. If the actual resonance frequency VS fn is not identical to but higher than the designed resonance frequency SET fn, operation 2 repeats in operation S3'.

A described above, the actual resonance frequency VS fn of the vibration speaker can be easily adjusted up and down to the designed resonance frequency SET fn using the method of correcting the actual resonance frequency VS fn.

Figure 8:
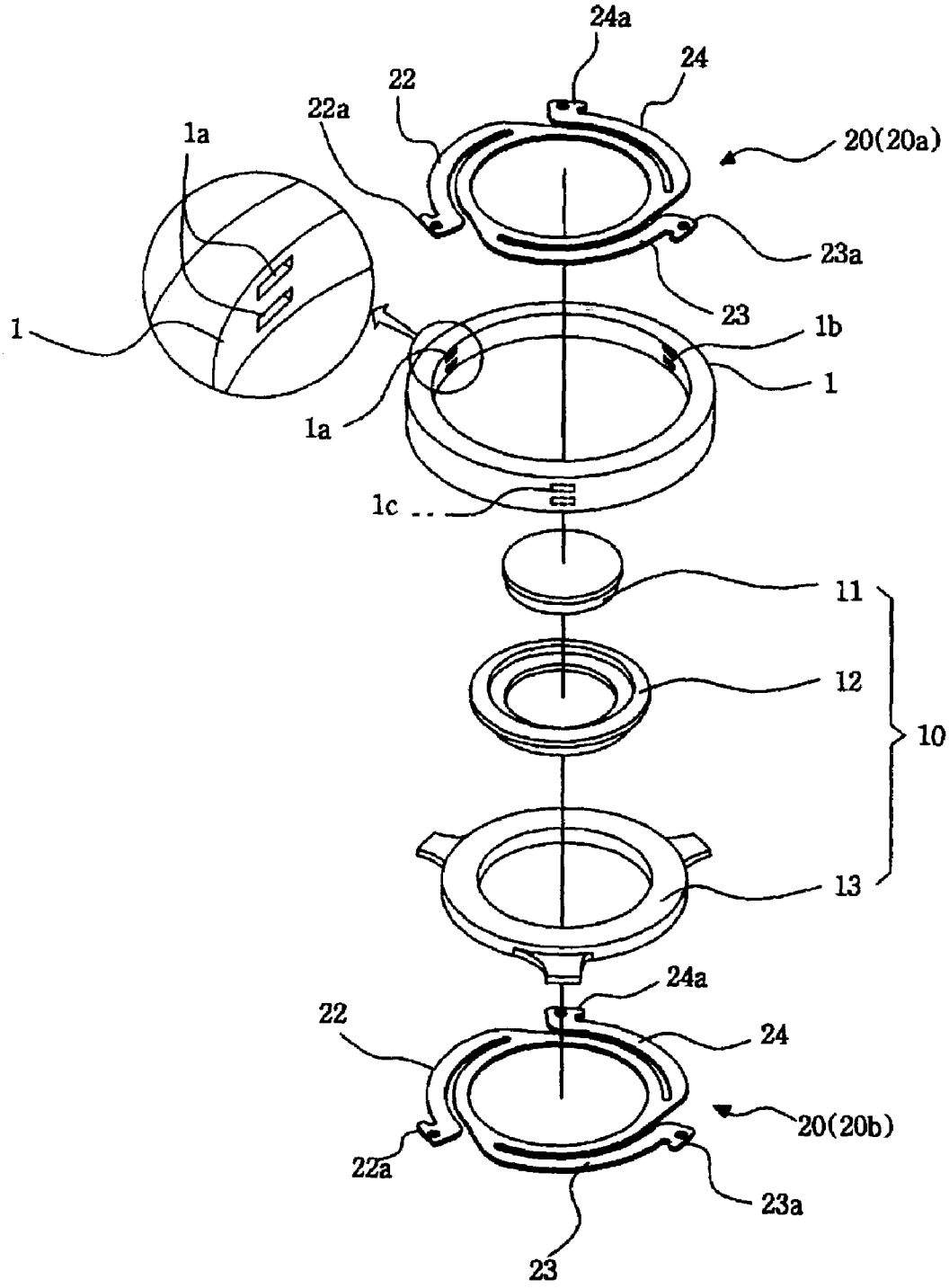
FIG. 8 is an exploded view of the vibration speaker formed by the process shown in FIGS. 7A and 7B.
Figure 10:
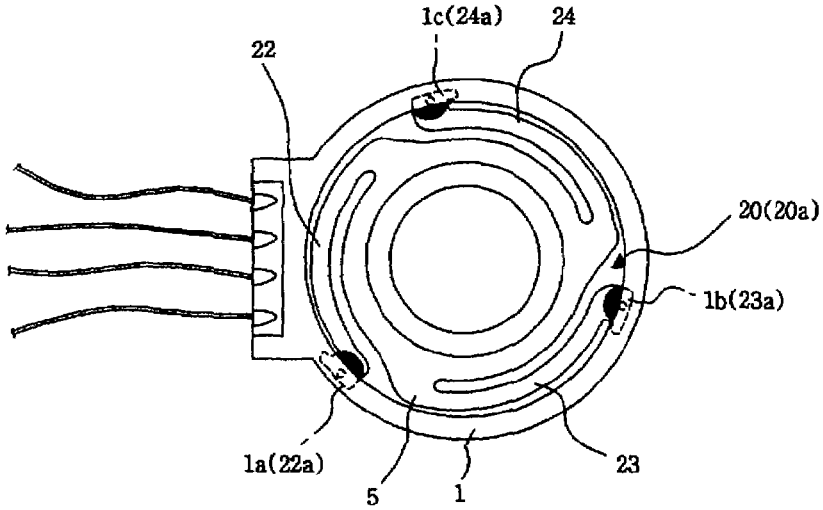
FIG. 10 is a plan view showing the elastic member of the vibration speaker shown in FIGS. 8 and 9.

FIGS. 8-10 show the vibration speaker having the actual resonance frequency adjusted according to the above method.

FIG. 8 is an exploded view of the vibration speaker using the method of correcting the resonance frequency, FIG. 9 is a cross-sectional view of the vibration speaker of FIG. 8, and FIG. 10 is a plan view of the elastic member 20 of the vibration speaker of FIG. 8.

As shown in FIGS. 8–10, the vibration speaker includes a case 100 having a cylindrical shape and forming an external shape, a vibration plate 3, and a coil 4 mounted on a bottom of the case 1 and below the vibration plate 3 to generate an electromagnetic force.

The coil 4 has windings in a circular shape, an upper portion of the coil 4 is fixedly attached to a lower surface of the vibration plate 3, and a lower portion of the coil 4 is extended to be designed adjacent to a magnet 11 of a vibration unit 10.

The vibration unit 10 includes the magnet 11 having N and S polarities and disposed below the coil 4 and a yoke 12 attached to a side of the magnet 11 to form a magnetic circuit corresponding to the electromagnetic force of the coil 4.

The vibration unit 10 is disposed to be spaced-apart from the coil 4 by the yoke 12 by a predetermined distance, and a weight 13 having a predetermined mass may be attached to an outer side of the yoke 12 to increase amplitude of vibration of the vibration unit 10.

The weight attached to the outer side of the yoke 12 is formed of a material which is not affected by a magnetic field.

A pair of the elastic member 20 have ends coupled to the inside of the case 1 to elastically support the vibration unit 10 disposed in a space within the case 1.

The elastic member 20 (20*a*, 20*b*) is the plate springs 20*a*, 20*b* shown in FIGS. 5A–5B and FIGS. 6A and 6B. The plate springs 20*a*, 20*b* are disposed on an upper side an a lower side of the yoke 12 and the ends of the plate springs 20*a*, 20*b* are fixedly coupled to the inside of the case 1 to support the vibration unit 10 to elastically move upward and downward.

The plate springs 20*a*, 20*b* are formed in a pair. The plate spring 20*a* is mounted on the upper side of the yoke, and the plate spring 20*b* is mounted on the lower side of the yoke 12.

The plate springs 20*a*, 20*b* have the same structure, and the ends of the plate spring 20*a*, 20*b* are inserted into and fixedly coupled to the inside of the case 1.

A plurality of grooves 1*a*, 1*b*, 1*c* are formed on the inside of the case to receive the respective ends of the plate springs 20*a*, 20*b*.

The protrusions 22*a*, 23*a*, 24*a* of the arms 22, 23, 24 corresponding to the ends of the plate springs 20*a*, 20*b* are inserted into and fixedly coupled to the respective grooves 1*a*, 1*b*, 1*c* of the case 1.

The arms 22, 23, 24 having the protrusions 22*a*, 23*a*, 24*a* of the plate springs 20*a*, 20*b*, are disposed in a circular direction of a center of the plate springs 20*a*, 20*b* at a predetermined interval of 120 degrees, and the grooves 1*a*, 1*b*, 1*c* of the case 1 are disposed to correspond to the respective protrusions 22*a*, 23*a*, 24*a*.

The vibration speaker using the method of correcting the resonance frequency generates audio sound and vibration when a high frequency current and a low frequency current selectively flow through the coil 4, respectively.

In order to generate the audio sound, the high frequency current flows through the coil 4, and the coil 4 generates the electromagnetic force moving the vibration plate upward and downward with the magnetic circuit of the vibration unit 10 to generate the audio sound.

In detail, the high frequency current of above 350 Hz flows through the coil 4 to provide a magnetic characteristic to the coil 4. The magnetic field of the coil 4 is the same as the magnet 11 of the vibration unit 10 to generate a repulse force and then the coil 4 is pushed upward together with the vibration plate 3.

When a direction of the high frequency current is changed to change the magnetic field reversed, then the magnet field of the coil 4 is different from that of the magnet 11, and the coil 4 moves toward the magnet 11 together with the vibration plate 3.

Accordingly, the vibration plate 3 is moved upward and downward by the coil 4 to vibrate to generate the audio sound.

In order to generate the vibration, a low frequency current of 100 Hz~200 Hz flows through the coil 4 to provide the magnetic characteristic to the coil 4. The magnetic field is formed by the coil 4. According to a direction of the low frequency current, the magnetic field is reversed.

The magnetic field of the coil 4 interacts with the magnetic circuit of the vibration unit 10 to move the vibration unit 10 upward and downward to generate the vibration.

In detail, when the magnetic field of the coil 4 is different from that of the magnet 11 of the vibration unit 10, an attractive force is generate, and the vibration unit 10 moves downward to be spaced-apart from the coil 4.

When the magnetic field of the coil is the same polarity as the magnet 11 of the vibration unit 10, the repulsive force is generated, and the vibration unit moves upward to be close to the coil 4 by the attractive force.

Since the vibration unit 10 is supported by the elastic member having the ends fixedly coupled to the inside of the case 1, the vibration unit 10 vibrates due to an elastic force of the elastic member 20.

A vibration coil 11*a* may be provided in the case to vibrate the vibration unit 10. When the vibration coil is mounted on the case 1, an insulation plate 2 should be provided on the bottom of the case 1 to insulate the inside from the outside of the case 1 as shown in FIG. 9.

When the vibration coil 11*a* having windings in a circular shape is mounted on upper surface of the plate 2, the low frequency current is supplied to the vibration coil 11*a* to vibrate the vibration unit 10.

The low frequency current having different polarities is applied to the vibration coil 11*a* to generate the magnet field corresponding the magnetic circuit of the vibration unit 10, thereby moving up and down the vibration unit 10.

That is, the vibration speaker generated the vibration using upward and downward movements of the vibration unit 10 due to the electromagnetic force of the vibration coil 11*a*.

As described above, the vibration speaker using the method of correcting the actual resonance frequency can generate the audio sound and the vibration using the coil 4 interacting with the vibration unit 10, or using the vibration coil 11*a*.

When the actual resonance frequency generated by the coil 4 or the vibration coil 11*a* of the vibration speaker is lower than the designed resonance frequency, the attaching element 30 is applied to the elastic portion of the elastic member 20 to adjust the strength of the elastic portion of the elastic member as shown in FIG. 9.

The attaching element 30 is applied to the elastic member 20 for the follow reasons. The strength of the plate springs 20*a*, 20*b* is changed when the fixed portions of the plate springs 20*a*, 20*b* are extended by the attaching element 30 to adjust the actual resonance frequency, which is lower than the designed resonance frequency due to the assembly dispersion (deviation) on the measurement dispersion (deviation), up to the designed resonance frequency.

The attaching element 30 may be the adhesive 32 solidified from a liquid state to a solid state and cured by the ultra violet light at a very fast speed. The 3062 UV series of the UV series is used as the adhesive 32.

The adhesive 32 is applied to the portions of the protrusions 22*a*, 23*a*, 24*a* of the arms 22, 23, 24 of the elastic member 20, thereby extending the fixed portion of the plate springs 20*a*, 20*b*, due to the adhesive 32.

Before the adhesive 32 is applied, the protrusions 22*a*, 23*a*, 24*a* of the plate springs 20*a*, 20*b* coupled to the respective grooves 1*a*, 1*b*, 1*c* are the fixed portions of the elastic member 20. When the adhesive 32 is applied, the portions of the protrusions 22*a*, 23*a*, 24*a* of the arms 22, 23, 24 become the fixed portion of the elastic member 20 as well as the protrusions 22*a*, 23*a*, 24*a*.

The portions of the protrusions 22*a*, 23*a*, 24*a* of the arms 22, 23, 24 are fixed on the inside of the case using the adhesive 32. In order to fixedly couple the portions to the inside of the case 1, the adhesive 32 is applied from the portions of the protrusions 22*a*, 23*a*, 24*a* of the arms 22, 23, 24 to the inside of the case 1.

It is possible that the adhesive 32 ejected on a portion where the inside of the case is perpendicular to the arms 22, 23, 24 of the plate springs 20*a*, 20*b* using the syringe as an ejector.

Since the UV series is used as the adhesive 32, the adhesive 32 is cured as soon as applied. Thus, an attaching area between the inside of the case 1 and the arms 22, 23, 24 can be easily obtained.

The adhesive 32 can be selectively applied to one of the plate springs 20*a*, 20*b* or both of the plate springs 20*a*, 20*b*.

In order to sequentially change the strength K of the plate springs 20*a*, 20*b*, the adhesive 32 can be applied to at least one of the arms 22, 23, 24 of the plate springs 20*a*, 20*b*, or to a plurality of the arms 22, 23, 24.

When the adhesive 32 is applied, the elastic portion of the plate springs 20*a*, 20*b* decreases, and the strength K of the plate springs 20*a*, 20*b* is changed to be increased.

According to a change of the strength K of the plate spring 20*a*, 20*b*, the actual resonance frequency VS fn is adjusted up to the designed resonance frequency when the vibration unit 10 vibrates.

Since the actual resonance frequency is adjusted up to a higher resonance frequency, the actual resonance frequency of the vibration speaker, which is lower than the designed resonance frequency, can be corrected to the designed resonance frequency.

When the actual resonance frequency is higher than the designed resonance frequency, the plate springs 50*a*, 50*b*, 50*a*', 50*b*' can be used to change the strength of the elastic member 20 instead of the plate springs 20*a*, 20*b*.

That is, each plate spring 50*a*, 50*b*, 50*a*', 50*b*' formed with the cutout portion C is fixedly coupled to the inside of the case 1 or the cutout portion C is formed on the plate springs 50*a*, 50*b*, 50*a*', 50*b*' to reduce a value of K, that is, the strength of the elastic member 20 to adjust the actual resonance frequency down to the designed resonance frequency.

A structure and an operation of the plate spring 50*a*, 50*b*, 50*a*', 50*b*' having the cutout portion C are described above in conjunction with FIGS. 6A and 6B. Accordingly, the related description thereof is omitted.

In order to easily correct the actual resonance frequency, the plate spring 20*a* having the attaching element 30 and the plate spring 50*a* having the cutout portion C may form a pair as the elastic member 20. To the contrary, the plate springs 20*a*, 50*a* of the elastic member 20 may have both the attaching element 30 and the cutout portion C.

As described above, when the actual resonance frequency generated by the vibration of the vibration unit 10 is lower than the designed resonance frequency due to the assembly dispersion or the measurement dispersion of the vibration unit 10, the attaching element 30 is provided on the elastic portion of the elastic member 20 fixed on the case 1 to extend the area of the fixed portion of the elastic member 20, thereby adjusting the actual resonance frequency to the higher resonance frequency close to the designed resonance frequency.

When the actual resonance frequency generated by the vibration of the vibration unit 10 is higher than the designed resonance frequency, the cutout portion C is provided as the elastic portion of the elastic member 20 to reduce the strength of the elastic member, thereby adjusting the actual resonance frequency to the lower resonance frequency close to the designed resonance frequency.

Therefore, the actual resonance frequency of the vibration unit 10 can be adjusted to be the same or similar to the designed resonance frequency. Accordingly, the vibration unit 10 is harmonized with the designed resonance frequency to have an optimum effective vibration amount to generate and stable vibration characteristic.

This method may compensate for the actual resonance frequency different from the designed resonance frequency occurring due to the assembly dispersion or the measurement dispersion, thereby improving a defect rate of the vibration speaker.

FIG. 11 shows an amount of a change of the actual resonance frequency of the vibration speaker shown in FIG. 9. Although the designed resonance frequency set in the vibration speaker of FIG. 9 is 182 Hz, the actual resonance frequency is 181.06 Hz or 178.21 Hz.

When the actual resonance frequency is 181.06 Hz, the adhesive 32 as the attaching element 30 is applied to one of the arms 22, 23, 24 of the elastic member 20 to adjust the actual resonance frequency to 182.36 Hz.

An amount of increment of the actual resonance frequency is 1.3 Hz. Since number below a decimal point in the actual resonance frequency of 182.36 Hz can be a very small amount, the actual resonance frequency of 182.36 Hz is regarded as close (identical) to the designed resonance frequency of 182 Hz.

The adhesive 32 is applied to the elastic member 20 for a period of 0.15 seconds using the syringe coupled to the needle having a diameter of 0.7 mm.

When the actual resonance frequency is 178.21 Hz, the adhesive 32 is applied to all the arms 22, 23, 24 of the plate springs 20*a*, 20*b*.

That is, the adhesive 32 is applied to the six arms 22, 23, 24 of the elastic member 20 to increase the actual resonance frequency by a great amount.

The adhesive 32 is applied to six portions, and the actual resonance frequency becomes 180.27 Hz which is close to the designed resonance frequency.

The adhesive 32 is not applied to the 6 portions at the same times, but applied to the respective portions one by one until the actual resonance frequency becomes the designed resonance frequency.

Accordingly, the vibration speaker is able to generate the actual resonance frequency identical to the designed resonance frequency.

The resonance frequency is 182 Hz as an example. However, the invention is not limited thereto. The resonance frequency can be set 139 Hz according to a user request.

Respective shapes and structure of the parts of the vibration speaker are variable according to the embodiments of the present invention, and the variable shapes and structures are within the scope of the invention.

As described above, the method of correcting the actual resonance frequency of the manufactured vibration speaker can change the strength of the elastic member to correct the actual resonance frequency when the actual resonance frequency is different from the designed resonance frequency. Accordingly, it is an advantage that a defect rate of the vibration speaker is reduced.

Since the method allows the vibration speaker to generate the designed resonance frequency, noise and damage occurring when the vibration unit contacts the case, are prevented, a lifespan of the vibration speaker is extended, and viability of the vibration speaker is also improved.

A manufacturing cost of the vibration speaker decreases compared to the manufacturing cost of a conventional method of manufacturing the vibration speaker by managing strictly respective processes of the parts constituting the vibration speaker.

Although a few preferred embodiments of the present invention have been shown and described, it would be appreciated by those skilled in the art that changes may be made in this embodiment without departing from the principle and spirit of the invention, the scope of which is defined in the claims and their equivalent.

What is claimed is:

1. A resonance frequency correcting method in a vibration speaker having a case and an elastic member disposed in the case, the method comprising:

determining whether an actual resonance frequency generated from the vibration speaker is identical to a reference resonance frequency;

solidifying a bonding element on an elastic portion of the elastic member to change strength of the elastic member to adjust the actual resonance frequency to a higher frequency than the actual resonance frequency when the actual resonance frequency is less than the reference resonance frequency; and solidifying the bonding element on another elastic portion of the elastic member when the higher resonance frequency is identical to the reference resonance frequency.

2. The method of claim 1, wherein the solidifying of the bonding element comprises:

filling an ejector with the bonding element;

applying the bonding element to the elastic portion of the elastic member using the ejector; and curing the bonding element using ultra violet light.

3. A vibration speaker generating audio sound and vibration, comprising:

a case having a vibration plate disposed on an upper portion of the case to generate the audio sound, and having a plurality of grooves formed on an inside of the case;

a coil having a side portion coupled to the vibration plate to generate an electromagnetic force;

a vibration unit disposed adjacent to the coil, having a magnet with opposite polarities, having a yoke attached to the magnet to form a magnetic circuit, and generating the vibration having an actual resonance frequency;

an elastic member elastically supporting the vibration unit, having a plurality of arms extended in an outside circumference, and having protrusions formed on the respective arms to be inserted into respective grooves, and causing the vibration unit to generate the actual resonance frequency; and a bonding element selectively applied to at least one of the arms to change strength of the elastic member to adjust the actual resonance frequency of the vibration unit.

4. The vibration speaker of claim 3, wherein the case comprises:

an insulation plate insulating an inside of the case from an outside of the case.

5. The vibration speaker of claim 4, further comprising:

a vibration coil disposed on an inside surface of the insulation plate to generate an electromagnetic force corresponding to the magnetic circuit of the vibration unit and to vibrate the vibration unit supported by the elastic member.

6. The vibration speaker of claim 3, wherein the vibration unit comprises:

a weight disposed on an outside of the yoke to increase a mass of the vibration unit to increase a vibration efficiency of the vibration unit.

7. The vibration speaker of claim 3, wherein the elastic member comprises:

a plate spring having a circular shaped plate.

8. The vibration speaker of claim 3, wherein the arms are disposed outward to be spaced-apart at an interval in a circular direction.

9. The vibration speaker of claim 3, wherein the bonding element is formed on two arms of the elastic member.

10. The vibration speaker of claim 3, wherein the bonding element is formed on three arms of the elastic member.

11. The vibration speaker of claim 3, wherein the bonding element comprises:

an adhesive applied to both the inside of the case and the protrusions of the elastic member to limit an elastic force of the elastic member to change the strength of the elastic member.

12. The vibration speaker of claim 11, wherein the adhesive comprises:

UV series cured by ultra violet light to be solidified at a curing speed to provide an attaching area of the elastic member and the inside of case.

13. The vibration speaker of claim 12, wherein the UV series comprises: 3062UV series having an anaerobic characteristic to shorten the curing speed.

* * * * *